US007503798B2

(12) United States Patent
Hashim

(10) Patent No.: US 7,503,798 B2
(45) Date of Patent: Mar. 17, 2009

(54) CROSS CONNECT SYSTEMS WITH SELF-COMPENSATING BALANCED CONNECTOR ELEMENTS

(75) Inventor: Amid Hashim, Plano, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 11/734,887

(22) Filed: Apr. 13, 2007

(65) Prior Publication Data

US 2007/0184725 A1 Aug. 9, 2007

Related U.S. Application Data

(63) Continuation-in-part of application No. 11/154,836, filed on Jun. 16, 2005, now Pat. No. 7,223,115.

(60) Provisional application No. 60/687,112, filed on Jun. 3, 2005.

(51) Int. Cl.
*H01R 4/24* (2006.01)

(52) U.S. Cl. ..... 439/405; 439/922; 439/939

(58) Field of Classification Search ..... 439/404, 439/405, 922, 941, 939
See application file for complete search history.

(56) References Cited

U.S. PATENT DOCUMENTS

| | | | |
|---|---|---|---|
| 5,199,899 | A | 4/1993 | Ittah |
| 5,226,835 | A | 7/1993 | Baker, et al. |
| 5,399,106 | A | 3/1995 | Ferry |
| 5,722,850 | A | 3/1998 | White |
| 5,730,608 | A | 3/1998 | Legrad |
| 5,762,516 | A | 6/1998 | Itoga et al. |
| 5,779,504 | A | 7/1998 | Dominiak et al. |
| 6,065,994 | A | 5/2000 | Hashim et al. |
| 6,107,578 | A | 8/2000 | Hashim |
| 6,288,334 | B1 | 9/2001 | Hennum |
| 6,309,240 | B1 | 10/2001 | Daoud |
| 6,494,723 | B2 | 12/2002 | Yamane et al. |
| 6,592,395 | B2 | 7/2003 | Brown et al. |

(Continued)

OTHER PUBLICATIONS

Belden Marketing Brief; 2007.

(Continued)

*Primary Examiner*—Renee S Luebke
*Assistant Examiner*—Harshad C Patel
(74) *Attorney, Agent, or Firm*—Myers Bigel Sibley & Sajovec

(57) ABSTRACT

A cross-connect wiring system includes a terminal block, a connecting block and a patch plug. The terminal block has a front side and a rear side. The connecting block is mounted on the front side of the terminal block. At least two pairs of tip and ring insulation displacement contacts (IDCs) are at least partially mounted within the connecting block. Each of these IDCs has a first end that includes a first conductor receiving slot and a second end that includes a second conductor receiving slot. The first and second ends of each IDC are non-collinear. Both the first and second conductor receiving slots of each IDC are on the front side of the terminal block. The patch plug includes a housing and at least two pairs of tip and ring plug contacts. The tip and ring plug contacts of at least one of the two pairs of tip and ring plug contacts cross over each other within the plug housing.

27 Claims, 8 Drawing Sheets

U.S. PATENT DOCUMENTS

| | | | |
|---|---|---|---|
| 6,612,880 | B2 | 9/2003 | Arnett et al. |
| 6,666,706 | B1 | 12/2003 | Jones et al. |
| 6,716,054 | B1 | 4/2004 | Denovich et al. |
| 6,729,899 | B2 | 5/2004 | Aekins et al. |
| 6,878,004 | B2 | 4/2005 | Oh |
| 7,223,115 | B2 | 5/2007 | Hashim et al. |
| 2006/0292920 | A1 | 12/2006 | Hashim et al. |

OTHER PUBLICATIONS

International Search Report and the Written Opinion of the International Searching Authority for PCT Application No. PCT/US2006/021472 dated Oct. 12, 2006.

GP6 Plus Connecting Block, Panduit Corp., http://www.panduit.com/products/Products.asp?param.

PCT International Search Report and Written Opinion for PCT/US2008/004039, Jul. 4, 2008.

CROSS CONNECT SYSTEMS WITH SELF-COMPENSATING BALANCED CONNECTOR ELEMENTS

RELATED APPLICATIONS

This application claims priority as a continuation-in-part application from U.S. patent application Ser. No. 11/154,836, filed Jun. 16, 2005 now U.S. Pat. No. 7,223,115,which in turn claims priority from U.S. Provisional Patent Application Ser. No. 60/687,112, filed Jun. 3, 2005, the disclosures of each of which are hereby incorporated by reference herein in their entireties.

FIELD OF THE INVENTION

The present invention relates generally to communications connectors and, more specifically, to cross connect systems.

BACKGROUND OF THE INVENTION

In an electrical communications system, it is sometimes advantageous to transmit information signals (e.g., video, audio, data) over a pair of conductors (hereinafter a "conductor pair" or a "differential pair" or simply a "pair") rather than a single conductor. The signals transmitted on each conductor of the differential pair have equal magnitudes, but opposite phases, and the information signal is embedded as the voltage difference between the signals carried on the two conductors. This transmission technique is generally referred to as "balanced" transmission. When signals are transmitted over a conductor such as a copper wire in a communications cable, electrical noise from external sources such as lightning, computer equipment, radio stations, etc. may be picked up by the conductor, degrading the quality of the signal carried by the conductor. With balanced transmission techniques, each conductor in a differential pair often picks up approximately the same amount of noise from these external sources. Because approximately an equal amount of noise is added to the signals carried by both conductors of the differential pair, the information signal is typically not disturbed, as the information signal is extracted by taking the difference of the signals carried on the two conductors of the differential pair; thus the noise signal is cancelled out by the subtraction process.

Many communications systems include a plurality of differential pairs. For example, high speed communications systems that are used to connect computers and/or other processing devices to local area networks and/or to external networks such as the Internet typically include four differential pairs. In such systems, the conductors of the multiple differential pairs are usually bundled together within a cable, and thus necessarily extend in the same direction for some distance. Unfortunately, when multiple differential pairs are bunched closely together, another type of noise referred to as "crosstalk" may arise.

"Crosstalk" refers to signal energy from a conductor of one differential pair that is picked up by a conductor of another differential pair in the communications system. Typically, a variety of techniques are used to reduce crosstalk in communications systems such as, for example, tightly twisting the paired conductors (which are typically insulated copper wires) in a cable, whereby different pairs are twisted at different rates that are not harmonically related, so that each conductor in the cable picks up approximately equal amounts of signal energy from the two conductors of each of the other differential pairs included in the cable. If this condition can be maintained, then the crosstalk noise may be significantly reduced, as the conductors of each differential pair carry equal magnitude, but opposite phase signals such that the crosstalk added by the two conductors of a differential pair onto the other conductors in the cable tends to cancel out. While such twisting of the conductors and/or various other known techniques may substantially reduce crosstalk in cables, most communications systems include both cables and communications connectors that interconnect the cables and/or connect the cables to computer hardware. Unfortunately, the communications connector configurations that were adopted years ago generally did not maintain the conductors of each differential pair a uniform distance from the conductors of the other differential pairs in the connector hardware. Moreover, in order to maintain backward compatibility with connector hardware that is already in place, the connector configurations have, for the most part, not been changed. As a result, many current connector designs generally introduce some amount of crosstalk.

In particular, in many conventional connectors, for backward compatibility purposes, the conductive elements of a first differential pair in the connector are not equidistant from the conductive elements that carry the signals of a second differential pair. Consequently, when the conductive elements of the first pair are excited differentially (i.e., when a differential information signal is transmitted over the first differential pair ), a first amount of signal energy is coupled (capacitively and/or inductively) from a first conductive element of the first differential pair onto a first conductive element of the second differential pair and a second, lesser, amount of signal energy is coupled (capacitively and inductively) from a second conductive element of the first differential pair onto the first conductive element of the second differential pair. As such, the signals induced from the first and second conductive elements of the first differential pair onto the first conductive element of the second differential pair do not completely cancel each other out, and what is known as a differential-to-differential crosstalk signal is induced on the second differential pair. This differential-to-differential crosstalk includes both near-end crosstalk (NEXT), which is the crosstalk measured at an input location corresponding to a source at the same location, and far-end crosstalk (FEXT), which is the crosstalk measured at the output location corresponding to a source at the input location. NEXT and FEXT each comprise an undesirable signal that interferes with the information signal. In many connector systems, a plurality of differential pairs will be provided, and differential-to-differential crosstalk may be induced between various of these differential pairs.

A second type of crosstalk, referred to as differential-to-common mode crosstalk, may also be generated as a result of, among other things, the conventional connector configurations. Differential-to-common mode crosstalk arises where the first and second conductors of a differential pair, when excited differentially, couple unequal amounts of energy on both conductors of another differential pair where the two conductors of the victim differential pair are treated as the equivalent of a single conductor. This crosstalk is an undesirable signal that may, for example, negatively effect the overall channel performance of the communications system.

Cross-connect wiring systems such as, for example, 110-style and other similar cross-connect wiring systems are well known and are often seen in wiring closets terminating a large number of incoming and outgoing wiring systems. Cross-connect wiring systems commonly include index strips mounted on terminal block panels which seat individual wires from cables. A plurality of 110-style punch-down wire connecting blocks are mounted on each index strip, and each connecting block may be subsequently interconnected with either interconnect wires or patch cord connectors encompassing one or more pairs. A 110-style wire connecting block has a dielectric housing containing a plurality of double-ended slotted beam insulation displacement contacts (IDCs) that typically connect at one end with a plurality of wires seated on the index strip and with interconnect wires or flat beam contact portions of a patch cord connector at the opposite end.

Two types of 110-style connecting blocks are most common. The first type is a connecting block in which the IDCs are generally aligned with one another in a single row (see, e.g., U.S. Pat. No. 5,733,140 to Baker, III et al., the disclosure of which is hereby incorporated herein in its entirety). The second type is a connecting block in which the IDCs are arranged in two rows and are staggered relative to each other (see, e.g. GP6 Plus Connecting Block, available from Panduit Corp., Tinley Park, Ill.). In either case, the IDCs are arranged in pairs within the connecting block, with the pairs sequenced from-n left to right, with each pair consisting of a positive polarized IDC designated as the "TIP" and a negatively polarized IDC designated as the "RING."

The staggered arrangement results in lower differential-to-differential crosstalk levels in situations in which interconnect wires (rather than patch cord connectors) are used. In such situations, the aligned type 110-style connecting block relies on physical separation of its IDCs or compensation in an interconnecting patch cord connector to minimize unwanted crosstalk, while the staggered arrangement, which can have IDCs that are closer together, combats differential-to-differential crosstalk by locating each IDC in one pair approximately equidistant from the two IDCs in the adjacent pair nearest to it; thus, the crosstalk experienced by the two IDCs in the adjacent pair is essentially the same, with the result that its differential-to-differential crosstalk is largely canceled.

These techniques for combating crosstalk have been largely successful in deploying 110-style connecting blocks in channels supporting signal transmission frequencies under 250 MHz. However, increased signal transmission frequencies and stricter crosstalk requirements have identified an additional problem: namely, differential-to-common mode crosstalk. This problem is discussed at some length in co-pending and co-assigned U.S. patent application Ser. No. 11/044,088, filed Mar. 25, 2005, the disclosure of which is hereby incorporated herein in its entirety. In addition, differential-to-differential crosstalk levels generally increase with increasing frequency, and conventional 110-style cross connect systems may not provide adequate differential-to-differential crosstalk cancellation at frequencies above 250 MHz.

SUMMARY OF THE INVENTION

Pursuant to embodiments of the present invention, patch plugs are provided. These patch plugs comprise a plug housing and first and second differential pairs of tip and ring plug contacts mounted within the housing. The first tip and ring plug contacts are mounted so as to cross over each other, as are the second tip and ring plug contacts. Each of the first and second tip and ring plug contacts include an insulation displacement contact (IDC) portion and a blade portion. The IDC portions of the first and second tip plug contacts are aligned in a first row, and the IDC portions of the first and second ring plug contacts are aligned in a second row that is spaced apart from the first row.

In some embodiments of these patch plugs, a slot in the IDC portion of the first tip plug contact may be generally aligned with a plane defined by the blade portion of the first ring plug contact, and a slot in the IDC portion of the first ring plug contact may be generally aligned with a plane defined by the blade portion of the first tip plug contact. Moreover, the first differential pair of tip and ring plug contacts may be balanced so as to impart substantially no differential-to-common mode crosstalk on the second differential pair of tip and ring plug contacts. In some embodiments, the IDC portions of the first and second tip plug contacts may lie within a first plane, and the blade portion of the first tip plug contact may lie within a second plane that is generally perpendicular to the first plane. Moreover, each of the first and second tip and ring plug contacts may include a cross-member that connects the IDC portion and the blade portion of the plug contact. The cross-member of the first ring plug contact may overlie the cross-member of the first tip plug contact, and the cross-member of the second ring plug contact may overlie the cross-member of the second tip plug contact. Furthermore, the cross-member of each of the first and second tip and ring plug contacts may be configured such that the differential-to-differential crosstalk imparted by the first differential pair of tip and ring plug contacts onto the second differential pair of tip and ring plug contacts is substantially cancelled.

In some embodiments, the above-described patch plugs may be provided in combination with a connector block. This connector block may include a housing and first and second pairs of tip and ring IDCs that are mounted in the housing. Each of these IDCs may have a first end that has a first slot and a second end that has a second slot, the first end being offset from the second end. Moreover, the tip IDCs may be aligned in a first row within the housing and the ring IDCs may be aligned in a second row within the housing. The first tip plug contact may be configured to mate with the first tip IDC, the first ring plug contact may be configured to mate with the first ring IDC, the second tip plug contact may be configured to mate with the second tip IDC and the second ring plug contact may be configured to mate with the second ring IDC.

In some embodiments, at least portions of the second end of each of the IDCs may extend outside the housing through one or more openings in the housing. In addition, the first slot and the second slot of each IDC may be generally parallel and non-collinear.

Pursuant to further embodiments of the present invention, cross-connect wiring systems are provided. These systems include a terminal block, a connecting block on the front side of the terminal block and a patch plug. At least two pairs of tip and ring insulation displacement contacts (IDCs) are mounted within the connecting block. Each of the IDCs has a first end that includes a first conductor receiving slot and a second end that includes a second conductor receiving slot. The first and second ends of each IDC are non-collinear, and both the first and second conductor receiving slots of each IDC are on the front side of the terminal block. The patch plus includes a housing and at least two pairs of tip and ring plug contacts. The tip and ring plug contacts of at least one of the two pairs of tip and ring plug contacts cross over each other within the housing.

In some embodiments of these cross-connect wiring systems, an index strip having a plurality of conductor receiving slots is provided on the terminal block. The connecting block may be mounted on the index strip so that the first conductor receiving slot of each IDC is aligned with one of the plurality of conductor receiving slots of the index strip. In these systems, each plug contact may include a blade and a terminal for making electrical contact with a wire. The tip IDC and the ring IDC of at least one of the pairs of IDCs cross over each other. In some cases, the first conductor receiving slot may be a slot of an insulation displacement contact and wherein the second conductor receiving slot may be a slot that mates with the blade of a respective one pf the plug contacts.

In these cross-connect wiring systems, the tip IDCs may be aligned in a first row and the ring IDCs may be aligned in a second row. In addition, the terminal for making electrical contact with a wire on each plug contact comprises an IDC, and the IDCs of the tip plug contacts are aligned in a first row and the IDCs of the ring plug contacts may be aligned in a second row. Moreover, the first pair of tip and ring plug contacts may be balanced so as to impart substantially no differential-to-common mode crosstalk on the second pair of tip and ring plug contacts.

Pursuant to still further embodiments of the present invention, cross-connect wiring systems are provided that include a connecting block that includes a plurality of pairs of tip and ring insulation displacement contacts (IDCs) mounted at least partially within the connecting block. In these connecting blocks, the tip IDCs are aligned in a first row and the ring IDCs are aligned in a second row, and each of the IDCs have a first end for electrically connecting with a first mating conductor and a second end for mating with a second mating conductor, the first end being offset from the second end. The cross-connect wiring system further includes a patch plug that includes a housing and at least two pairs of tip and ring plug contacts. Each plug contact includes an IDC portion and a blade portion. The IDC portions of the tip plug contacts are aligned in a first row and the IDC portions of the ring plug contacts are aligned in a second row. Moreover, the tip and ring plug contacts of at least one of the pairs of plug contacts cross over each other within the housing.

In some embodiments, a slot in the IDC portion of the tip plug contact of the first pair of plug contacts is generally aligned with a plane defined by the blade portion of the ring plug contact of the first pair of plug contacts, and a slot in the IDC portion of the ring plug contact of the first pair of plug contacts is generally aligned with a plane defined by the blade portion of the tip plug contact of the first pair of plug contacts. The first end of a first IDC of a first of the pairs of IDCs may be substantially equidistant from the first ends of both IDCs of a second of the pairs of IDCs. The tip IDC and the ring IDC of each of the pairs of IDCs may cross over each other, and each of the IDCs may be substantially planar.

DETAILED DESCRIPTION

Figure 1:
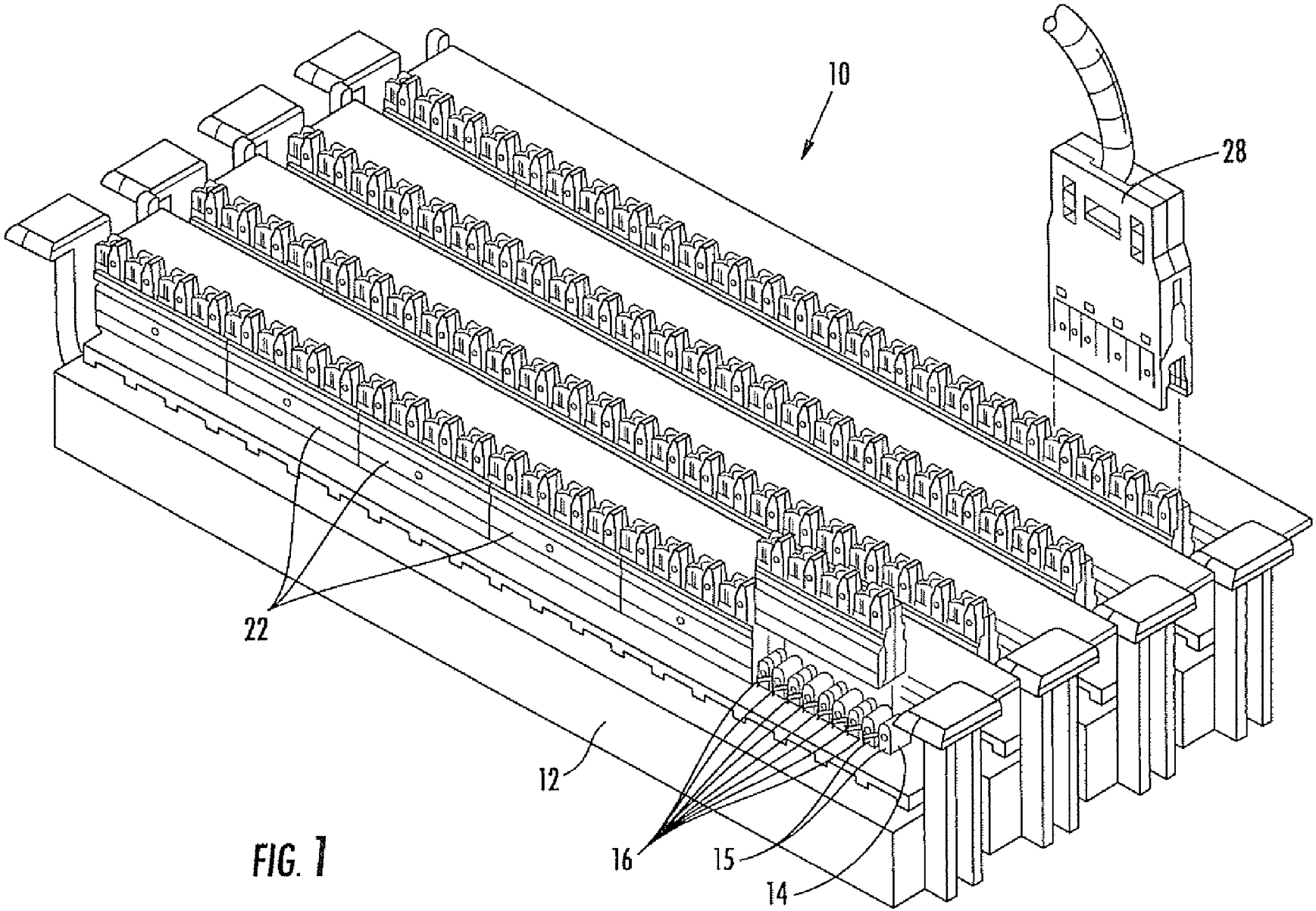
FIG. 1 is a perspective view of a cross-connect system employing a connector according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constrictions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Where used, the terms "attached", "connected", "interconnected", "contacting", "mounted" and the like can mean either direct or indirect attachment or contact between elements, unless stated otherwise.

Communications connectors according to embodiments of the present invention will now be described with respect to FIGS. 1-11. In FIGS. 1-11, concepts according to embodiments of the present invention are implemented in a 110-style cross-connect wiring system. It will also be appreciated that the concepts discussed herein are applicable to other types of communications connectors such as, for example, a number of cross-connect systems that are known in the art that are not compatible with 110-style cross-connect wiring systems.

FIG. 1 depicts a 110-style cross-connect communications system 10, which is a well-known type of communications system that is often used in wiring closets that terminate a large number of incoming and outgoing wiring systems. The communications system 10 comprises field-wired cable termination apparatus that is used to organize and administer cable and wiring installations. The communications system 10 would most typically be located in the equipment room and may provide termination and cross-connection of network interface equipment, switching equipment, processor equipment, and backbone (riser or campus) wiring. The cross-connect communications system 10 is typically located in a telecommunications closet and may provide termination and cross-connection of horizontal (to the work area) and backbone wiring. Cross-connects can provide efficient and convenient routing and rerouting of common equipment circuits to various parts of a building or campus.

As shown in FIG. 1, the communications system 10 has connector ports 15 arranged in horizontal rows. Each row of connector ports 15 comprises a conductor seating array 14 that is commonly referred to as an "index strip." Conductors (i.e., wires) 16 are placed between the connector ports 15. As is also shown in FIG. 1, once the conductors 16 are in place, connecting blocks 22 are placed over the index strips 14. Each connecting block 22 may include a plurality of double-ended slotted beam insulation displacement contacts (IDCs), which are not visible in FIG. 1. Each IDC may make mechanical and electrical connection to a wire and, in particular, to a wire that is surrounded by dielectric insulation. A first end of each IDC may include a pair of opposing contact fingers that strip insulation from a wire that is pressed between the contact fingers so that an electrical contact is made between the wire and the IDC. The other end of each IDC may be similarly constructed, and may likewise make mechanical and electrical connection to a wire.

As is shown in FIG. 1, a first end of each IDC in connecting block 22 forms an electrical contact with a respective one of the conductors (wires) 16 mounted in the index strip 14. The second end of each IDC may likewise make an electrical connection with a cross-connect wire (not shown). More commonly, however, as shown in FIG. 1, instead of connecting to a wire, the second end of each IDC receives a blade of a patch plug 28. The patch plug is part of a patch cord that includes a plurality of differential pairs and a plug 28 on at least one end that is used to electrically connect each differential pair to a corresponding pair of IDs in the connecting block 22.

FIG. 1 shows four horizontal rows of six connecting blocks 22 each that are mounted on top of four index strips 14 (only a portion of one of the index strips 14 is visible in FIG. 1) in a typical terminal block 12. The spaces between the index strips 14 become troughs, typically for cable or cross-connect wire routing. The conductors 16 are routed through the cable troughs and other cabling organizing structure to their appropriate termination ports in the index strips 14.

An exemplary connecting block 22 may include a main housing 40, two locking members 48 and eight IDCs 24*a*-24*h*. These components are described below with respect to FIGS. 2-7.

Figure 4:
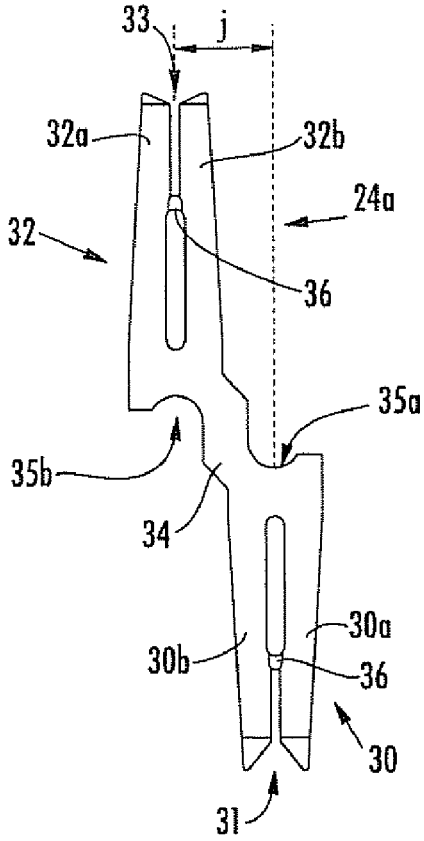
FIG. 4 is an enlarged front view of an exemplary IDC of the connecting block of FIG. 2.

FIG. 4 illustrates an exemplary IDC, IDC 24*a*, of the connecting block 22. IDCs are a known type of wire connection terminal. In general, a wire connection terminal refers to an electrical contact that receives a wire or a plug blade, or some other type of electrical contact, at one end thereof (or at both ends in the case of a double-slotted IDC). The IDC 24*a* is generally planar and formed of a conductive material, such as, for example, a phosphor bronze alloy. The IDC 24*a* includes a lower end 30 with prongs 30*a*, 30*b* that define an open-ended slot 31 for receiving a mating conductor, an upper end 32 with prongs 32*a*, 32*b* that define an open-ended slot 33 for receiving another mating conductor, and a transitional area 34. Each of the slots 31, 33 may be interrupted by a small brace 36 that provides rigidity to the prongs of the IDC 24*a* during manufacturing, but which splits during "punch-down" of conductors into the slots 31, 33. The lower and upper ends 30, 32 are offset from each other such that the slots 31, 33 are generally parallel and non-collinear. The offset distance "j" between the slots 31, 33 in the lower and upper ends 30, 32 may, for example, be between about 0.080 and 0.150 inches.

Figure 2:
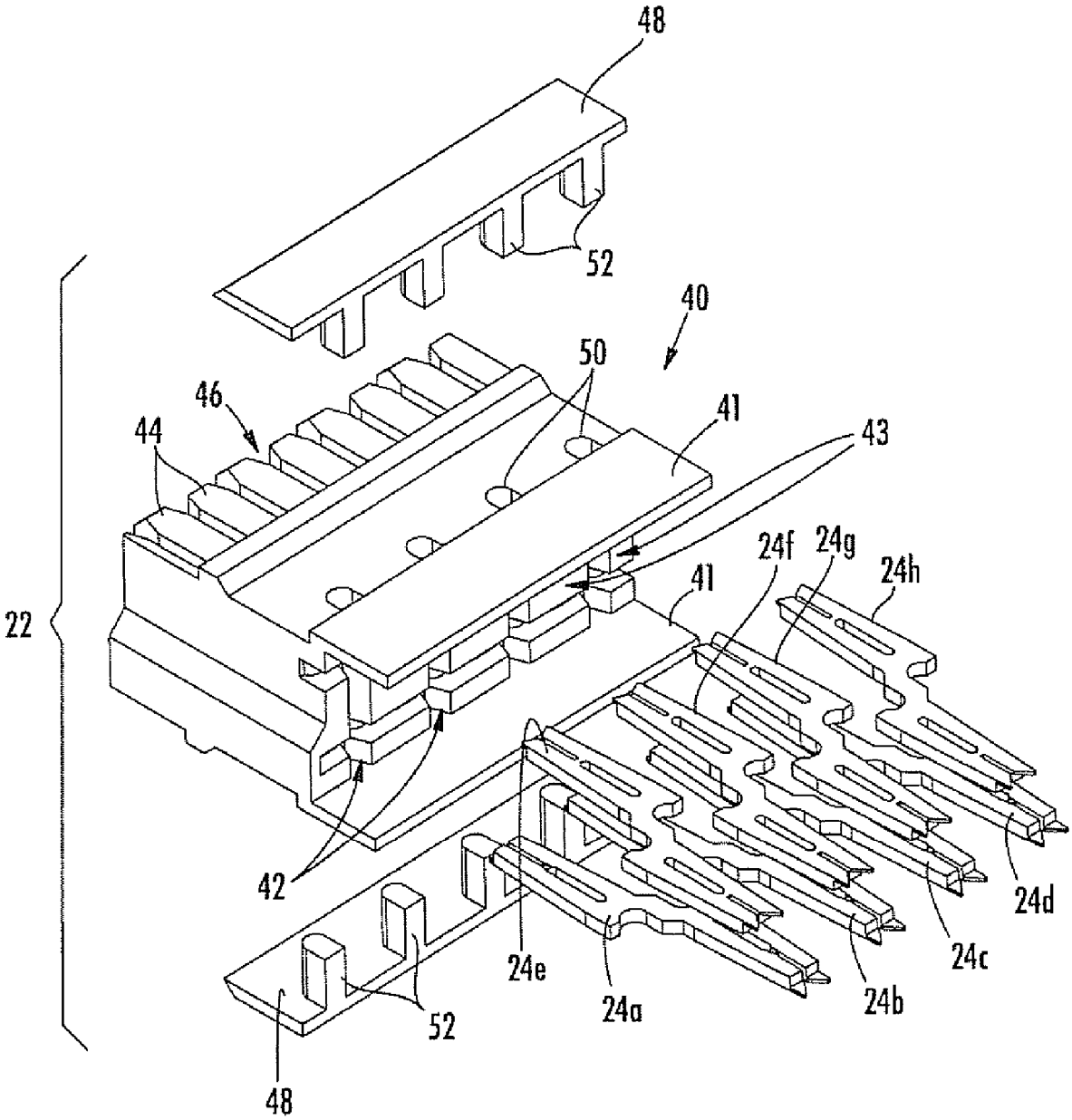
FIG. 2 is an exploded perspective view of a connecting block employed in the cross-connect system illustrated in FIG. 1.
Figure 3:
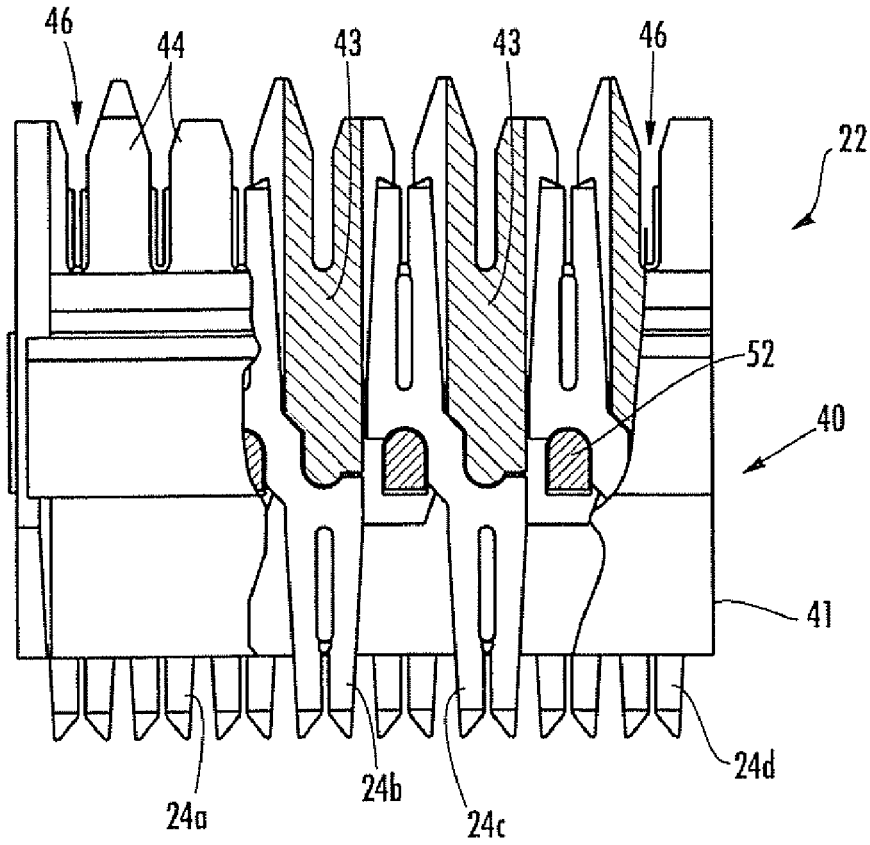
FIG. 3 is a front partial section view of tie connecting block of FIG. 2.

Referring now to FIGS. 2 and 3, the main housing 40, which may, for example, be formed of a dielectric material such as polycarbonate, has flanges 41 which may serve to align the connecting block 22 over the index strip 14 with which it mates. The main housing 40 includes through slots 42 separated by dividers 43, each of the slots 42 being sized to receive the upper end 32 of an IDC 24*a*-241*h*. The upper end of the main housing 40 has multiple pillars 44 that are defined by slits 46. The slits 46 expose the inner edges of the open-ended slots 33 of the IDC tipper ends 32. The main housing 40 also includes apertures 50 on each side. As shown in FIG. 2, the locking members 48 are mounted to the sides of the main housing 40. The locking members 48 include locking projections 52 that are received in the apertures 50 in the main housing 40.

As is illustrated in FIG. 3, the connecting block 22 can be assembled as follows. The IDCs 24*a*-24*h* are inserted into the slots 42 in the main housing 40 from the lower end thereof The upper ends 32 of the IDCs 24*a*-24*h* fit within the slots 42, with the slots 33 of the upper ends 32 of the IDCs 24*a*-24*h* being exposed by the slits 46 in the main housing 40. Recesses 35*a* of the IDCs 24*a*-24*h* engage the lower ends of respective dividers 43 of the main housing 40. Once the IDCs 24*a*-24*h* are in place, the locking members 48 are inserted into the apertures 50 such that the arcuate surfaces of the locking projections 52 engage the recesses 35*b* of the IDCs 24*a*-241*t*. The locking members 48 are then secured via ultrasonic welding, adhesive bonding, snap-fit latching, or some other suitable attachment technique. The interaction between the recesses 35*a*, 35*b*, the lower ends of the dividers 43, and the locking projections can anchor the IDCs 24*a*-24*h* in place and prevent twisting or rocking of the IDCs 24*a*-24*h* relative to the main housing 40 during wire punch-down.

Figure 5:
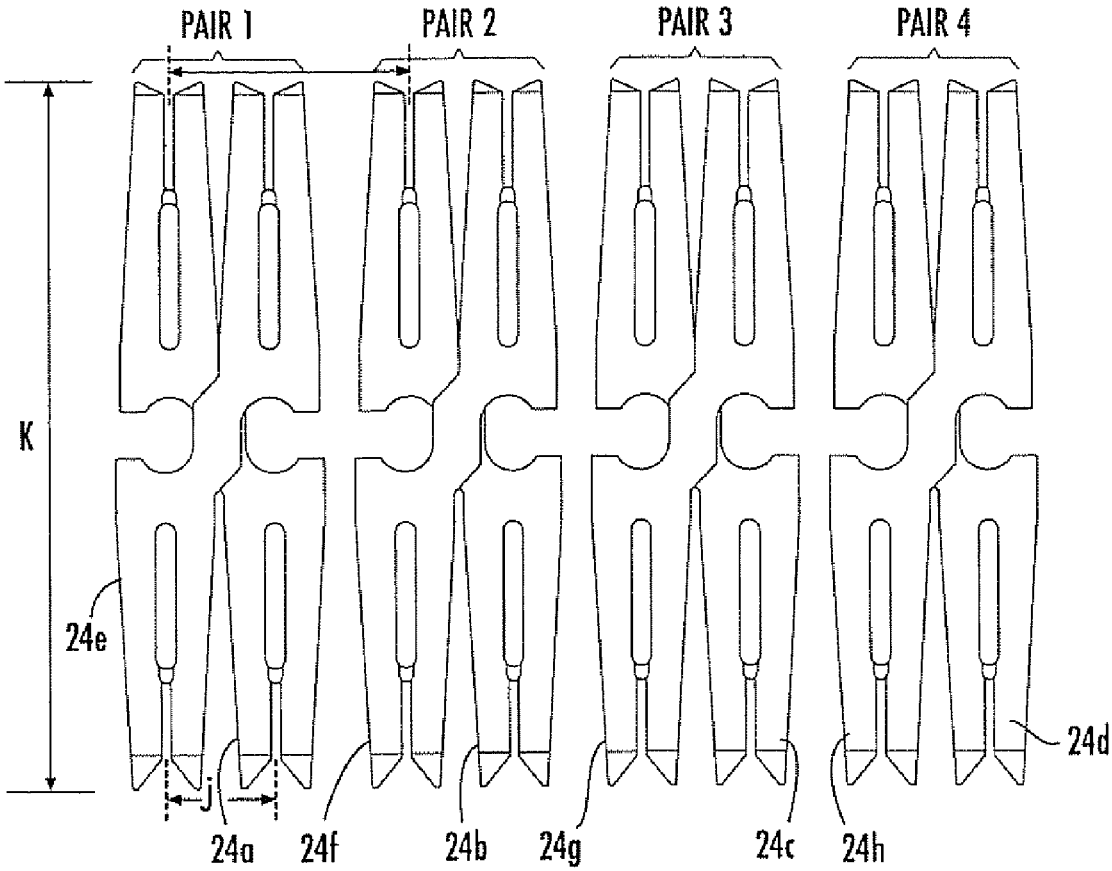
FIG. 5 is a front view of the arrangement of IDCs in the connecting block of FIG. 2.
Figure 6:
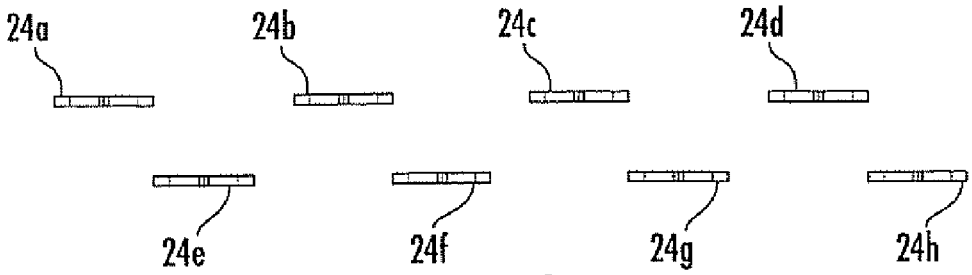
FIG. 6 is a top view of the IDCs of FIG. 5, that only shows the top end of each IDC.
Figure 7:
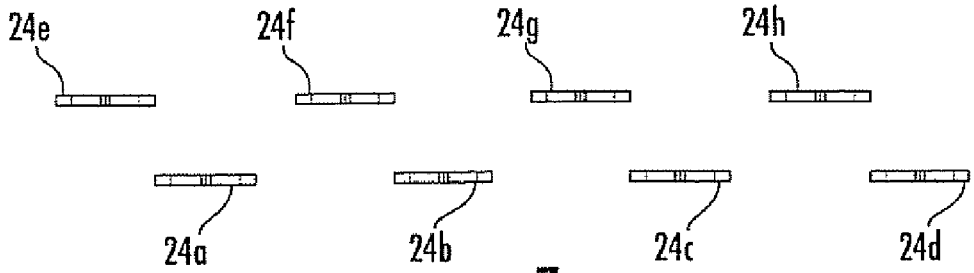
FIG. 7 is a bottom view of the IDCs of FIG. 5, that only shows the bottom end of each IDC.

As can be seen in FIGS. 3 and 5, once in the main housing 40, the IDCs 24*a*-24*h* are arranged in two substantially planar rows, with IDCs 24*a*-24*d* in one row and IDCs 24*e*-241*h* in a second row. As can be seen in FIG. 6 (which only depicts the upper half of each IDC) because of the "jogs" in the IDCs (i.e., the offset between the upper and lower ends 32, 30 of the IDCs), the upper ends 32 of the IDCs 24*a*-24*d* in one row are staggered from the upper ends 32 of the IDCs 24*e*-24*h* in the other row. Likewise, as can be seen in FIG. 7 (which only depicts the lower half of each IDC), the lower ends 30 of the IDCs 24*a*-24*d* are staggered from the lower ends 30 of the IDCs 24*e*-24*h*. In the embodiment of connecting block 22 shown in FIGS. 2-3 and 5, the transitional area 34 of the IDCs in opposing rows are aligned (e.g., the transition area 34 of IDC 24*a* is directly across from the transition area 34 of IDC 24*e*). In other embodiments, the transition -areas 34 of opposing IDCs may be staggered.

The IDCs 24*a*-24*h* can be divided into TIP-RING IDC pairs as set forth in Table 1 below, where by convention, tile TIP is the positively polarized terminal and the RING is the negatively polarized terminal. Each of the RINGS of the IDC pairs are in one row, and each of the TIPS of the IDC pairs are in the other row.

TABLE 1

| IDC | Pair # | Type |
|---|---|---|
| 24a | 1 | TIP |
| 24b | 2 | TIP |
| 24c | 3 | TIP |
| 24d | 4 | TIP |
| 24e | 1 | RING |
| 24f | 2 | RING |
| 24g | 3 | RING |
| 24h | 4 | RING |

As is shown in FIG. 5, the length of each IDC 24*a*-24*h* may be a distance "k." In an exemplary embodiment of the present invention, "k" may be about 800 mils. In the exemplary embodiment shown in FIG. 5, the distance "j" between adjacent slots of the IDCs of an IDC pair may be about 96 mils. In the exemplary embodiment shown in FIG. 5, the distance "1" between the slots of adjacent IDCs in a row of IDCs may be about 260 mils. The first and second rows of IDCs may be separated by about 70 mils.

As is best seen in FIG. 5, the resulting arrangement of the IDCs 24*a*-24*h* is one in which the IDCs of each pair "crossover" each other. Also, in this embodiment the distance between (a) the upper end of the IDC of one pair and the IDCs of an adjacent pair and (b) the lower end of the other IDC of the pair and the lower ends of the IDCs of the adjacent pair are generally the same. As a result, the TIP of each pair and the RING of each pair are in close proximity to the IDCs of adjacent pairs for generally the same signal length and at generally the same distance. For example, as seen in FIG. 6, the upper end 32 of the RING of pair 1 (IDC 24*e*) is closer to the upper ends 32 of the TIP and RING of pair 2 (IDCs 24*b*, 24*f*) than is the upper end 32 of the TIP of pair 1 (IDC 24*a*). However, as can be seen in FIG. 7, the lower end 30 of the TIP of pair 1 (IDC 24*a*) is closer to the lower ends 30 of the TIP and RING of pair 2 (IDCs 24*b*, 24*f*) than is the lower end of the RING of pair 1 (IDC 24*e*). This pattern holds for all of the pairs of IDCs in the connecting block 22, and continues along the entire array of connecting blocks mounted on the index strip 14; in each instance, the exposure (based on signal length and proximity) of each IDC to the members of neighboring pairs of IDCs is generally the same.

As a consequence of this configuration, the IDCs can self-compensate for differential-to-common mode crosstalk. The opposite proximities on the upper and lower ends of the TIP and RING IDCs of one pair to the adjacent pair can compensate the capacitive crosstalk generated between the pairs. The presence of the crossover in the signal-carrying path defined by the IDCs can compensate for the inductive crosstalk generated between the pairs. At the same time the arrangement of the IDCs at the upper end 32 and the lower end 30 enables the IDCs to self-compensate for differential-to-differential crosstalk by locating each IDC in one pair approximately equidistant from the two IDCs in the adjacent pair nearest to it. Because both the differential-to-common mode crosstalk as well as the differential-to-differential crosstalk between pairs are compensated, the connecting block 22 can provide improved crosstalk performance, particularly at elevated frequency levels.

In a number of cross-connect systems, the electrical performance of the system may be optimized when the connecting blocks 22 are terminated with punch down wires. When the connecting block 22 is instead terminated using patch plugs 28, the electrical performance of the connecting block 22 may degrade. As a result, in some systems, it is necessary to impose more restrictive cable length restrictions or other restrictions on the cross-connect system to ensure that the performance of the cross-connect system complies with applicable standards when some or all of the connecting blocks 22 are terminated using patch plugs 28 as opposed to punch down wires.

Figure 8:
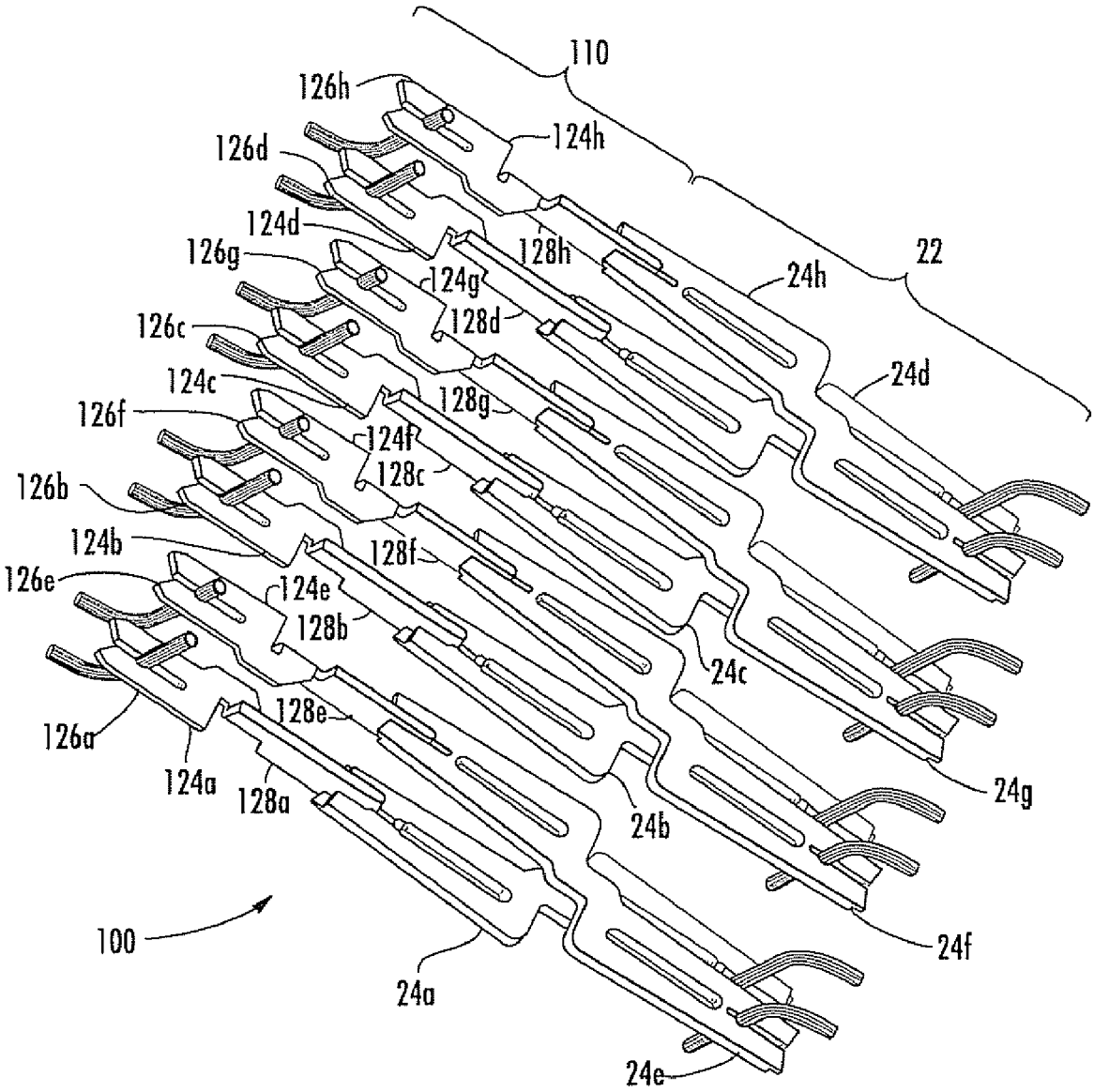
FIG. 8 is a perspective view of the conductive elements of a conventional plug and the connecting block of FIG. 2.

FIG. 8 is a perspective view of the IDCs 24*a*-24*h* of a connecting block 22 mating with the contacts 124*a*-124*h* of a conventional mating patch plug 110. In FIG. 8, the main housing 40 of the connecting block 22 and the main housing 120 of the patch plug 110 are omitted to more clearly illustrate the configuration of the mating conductive elements. Unfortunately, in the configuration of FIG. 8, the level of differential-to-differential crosstalk self-compensation provided by the staggered arrangement of the plug contacts 124*a*-124*h* may be insufficient. In particular, as shown in FIG. 8, each plug contact 124*a*-124*h* includes a respective IDC region 126*a*-126*h* and a blade region 128*a*-128*h*. As the IDC regions 126*a*-126*d* of plug contacts 124*a*-124*d* are aligned in a first (lower) row, and the IDC regions 126*e*-126*h* of plug contacts 124*e*-124*h* are aligned in a second (upper) row, the differential-to-differential coupling between two adjacent pairs of the plug contacts 124*a*-124*h* in the IDC regions 126*a*-126*h* may be, to a large extent, self-compensated—i.e., the coupling between a plug contact of the disturbing pair and the like plug contact in the adjacent disturbed pair (e.g. ring1-ring2 or 126*e*-126*f*) and the coupling between the same plug contact in the disturbing pair and its unlike plug contact in the adjacent disturbed pair (e.g. ring1-tip2 or 126*e*-126*b*) are roughly of the same order of magnitude. However, the differential-to-differential crosstalk between adjacent pairs in the blade region 128*a*-l28*h* of the plug contacts 124*a*-124*h* may be largely uncompensated, as the coupling between a plug contact in the disturbing pair and its unlike plug contact in the adjacent disturbed pair (e.g. ring1-tip2 or 128*e*-128*b*) may be significantly larger in the blade region than the coupling between the same plug contact of the disturbing pair and the like plug contact in the adjacent disturbed pair (e.g. ring1-ring2 or 128*e*-128*f*). The prior art plug contacts 124*a*-124*h* may also be inherently unbalanced as far as the differential-to-common mode crosstalk between two adjacent pairs due to the sizable difference in the physical proximities of the tip and ring of the disturbing pair to the adjacent disturbed pair (e.g. ring1 is much closer to pair 2 than tip 1).

Pursuant to further embodiments of the present invention, self-compensating cross-connect systems are provided that include balanced plugs so as to have low differential-to-differential and low differential-to-common mode crosstalk when patch plugs are used in the cross-connect system. As a result, the additional cable length restrictions that may be necessary with conventional cross-connect systems when such systems are used in conjunction with patch plugs may be reduced or eliminated.

Figure 9:
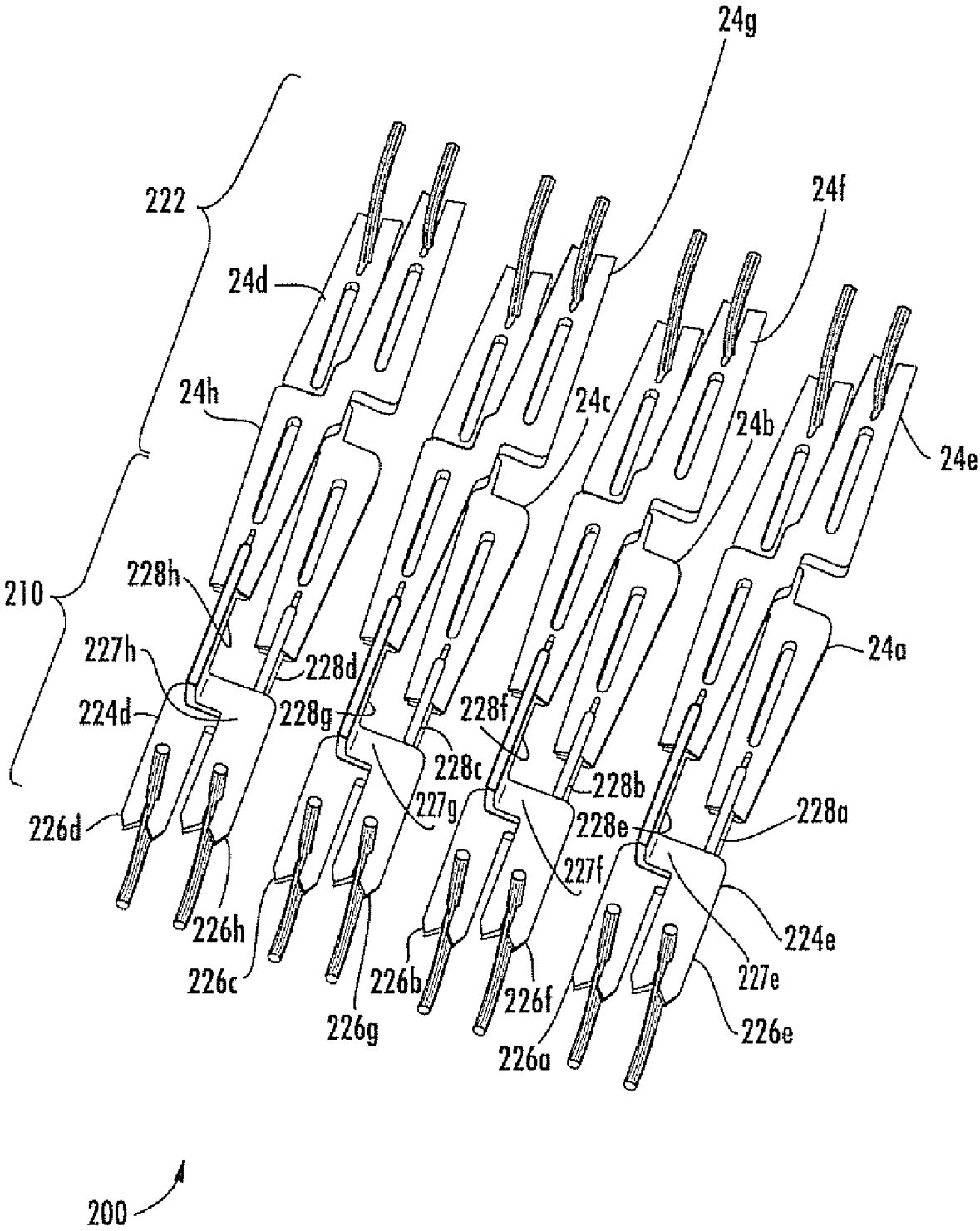
FIG. 9 is a perspective view of the conductive elements of a plug and a connecting block according to certain embodiments of the present invention.
Figure 11:
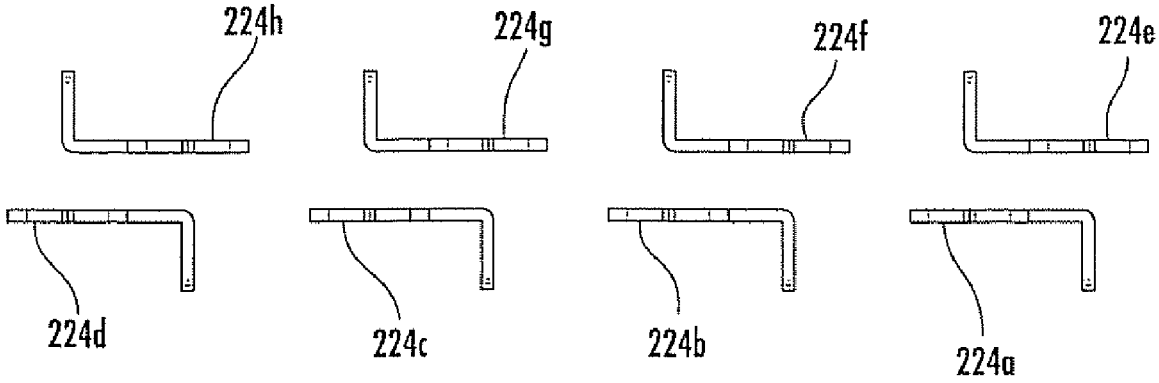
FIG. 11 is an end view of the plug contacts of the plug of FIG. 9.

FIG. 9 depicts a connecting block 222 and a patch plug 210 of a cross-connect system 200 according to such further embodiments of the present invention. As with FIG. 8, in FIG. 9 the main housing 240 of the connecting block 222 and the main housing 220 of the patch plug 210 are omitted to more clearly illustrate the configuration of the mating conductive elements. FIG. 11 is an end view of the plug contacts of FIG. 9.

As shown in FIG. 9, the IDCs 224*a*-224*h* that are included in the connecting block 222 may be identical in design and configuration to the IDCs 24*a*-24*b* discussed above. As such, further discussion of IDCs 224*a*-224*h* will be omitted. The plug 210 includes eight plug contacts 224*a*-224*h*. Each plus contact includes a respective IDC region 226*a*-226*h* and a respective blade region 228*a*-228*h*. In addition, each plug contact 224*a*-224*h* includes a respective cross-over segment 227*a*-227*h* (only crossover segments 227*e*-227*h* are labeled in FIG. 9 as crossover segments 227*a*-227*d* are mostly obscured by crossover segments 227*e*-227*h*, respectively). As discussed below, these cross-over segments 227*a*-227*h* may be configured to provide self-compensating plug contacts.

In particular, as shown in FIG. 9, the cross-over segments 227*a*-227*h* may be used to reverse the respective positions of the respective IDC regions 226*a*-226*h* on each pair of plug contacts 224*a*-224*h*. For example, referring to FIG. 8 and focusing on the plug contacts 124*a* (tip1) and 124*e* (ring1) which form pair 1, it can be seen that in the conventional design, the IDC region 126*e* of contact 124*e* (ring1) is closer to the plug contacts 124*b*, 124*f* of pair 2 than is the IDC region 126*a* of contact 124*a* (tip1). In contrast, as shown in FIG. 9, in the plug 210 according to embodiments of the present invention, the IDC region 226*e* of contact 224*e* (ring1) is further from the plug contacts 224*b*, 224*f* of pair 2 than is the IDC region 226*a* of contact 224*a* (tip1). By reversing the respective positions of the IDC regions of the plug contacts of each pair of plug contacts it may be possible to provide a self-compensating plug that compensates in the IDC regions for differential-to-common mode crosstalk that is generated in the blade regions of the plug contacts. Moreover, as shown in FIG. 9, the crossover segments 227*a*-227*h* may be configured to provide coupling of opposite polarity to the differential-to-differential crosstalk generated in the plug blades, as the coupling between a plug contact in the disturbing pair and its like plug contact in the adjacent disturbed pair (e.g. ring1-ring2 or 227*e*-227*f*) may be significantly larger in the cross-over segment region than the coupling between the same plug contact of the disturbing pair and the unlike plug contact in the adjacent disturbed pair (e.g. ring1-tip2 or 227*e*-227*b*). Thus it may be possible to configure the crossover segments 227*a*-227*h* of the plug contacts 224*a*-224*h* to provide a self-compensating plug that compensates in the crossover segments 227*a*-227*h* for differential-to-differential crosstalk that is generated in the blade regions 228*a*-228*h* of the plug contacts 224*a*-224*b*.

Figure 10:
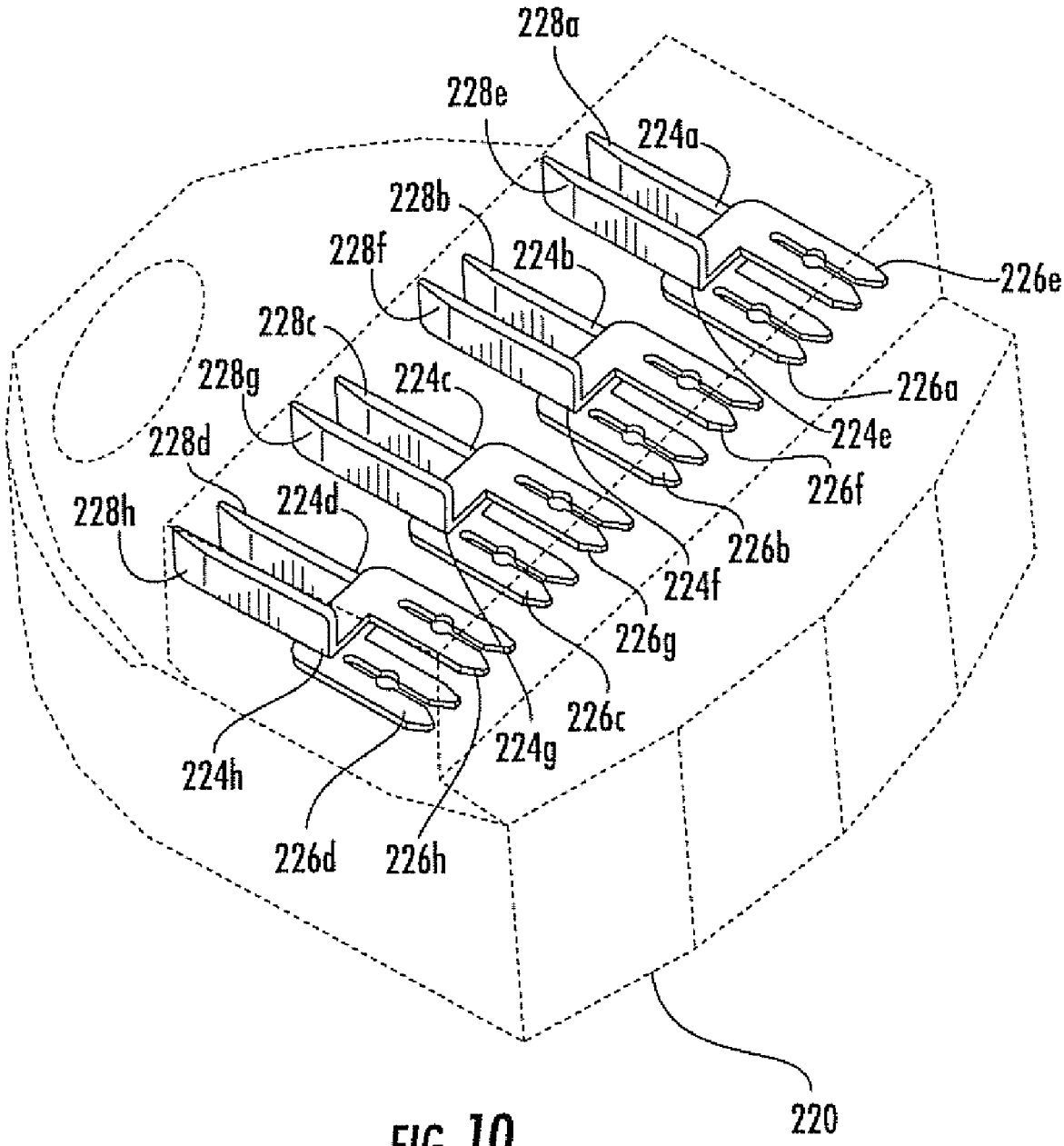
FIG. 10 is an exploded perspective view of the plug of FIG. 9.

FIG. 10 is a perspective view of the patch plug 210 of FIG. 9. The patch plug 210 may be part of a patch cord that includes a cable (not shown) and the patch plug 210. The cable may comprise four differential pairs of conductors that are twisted together in a manner to reduce crosstalk as is known to those of skill in the art. The cable may also include a separator that separates at least one of the twisted differential pairs from another of the twisted differential pairs, and a jacket which encloses the differential pairs and the separator. A core twist may be applied to the twisted differential pairs.

The patch plug 210 may include a dielectric housing 220. The dielectric housing may be formed of two pieces which snap together and capture plug contacts 224*a*-224*h*. The housing may be molded from a polycarbonate resin or other suitable material. The housing may include slots or other structure that is configured to receive and hold plug contacts 224*a*-224*h* in place. The plug contacts 224*a*-224*h* may be factory-installed and firmly embedded in the housings Each conductor of the four differential pairs in the cord terminates into a respective one of the IDCs provided at the respective IDC regions 226*a*-226*h* of the plug contacts 224*a*-224*h*. The conductors of the differential pairs are connected so that the differential pair relationship in the cable is maintained in the plug. The housing 220 may also include other conventional features such as a strain relief mechanism, a detainment latch, alignment flanges and the like which are known to those of skill in the art and thus will not be discussed further herein.

In the particular embodiment of the patch plug 210 of FIGS. 9-10, the improved differential-to-differential and differential-to-common mode crosstalk performance is provided by designing the plug contacts of each differential pair to cross over each other via the respective cross-over segments 227*a*-227*h*, with each crossover segment confined to the same plane as the respective IDC portion. It will be appreciated, however, in light of the present disclosure that, in other embodiments, the cross-over segments 227*a*-227*h* may be implemented in numerous different ways and with a wide variety of different shapes and/or configurations that would provide opposite polarity coupling relative to the differential to differential crosstalk generated in the plug blades.

Those skilled in this art will appreciate that connecting blocks, IDCs, patch plugs and plug contacts according to embodiments of the present invention may take other forms. For example, the components of the connecting block and plug housings may be replaced with a wide variety of different housing shapes and/or configurations. The number of pairs of IDCs and/or plug contacts may differ from the four pairs illustrated herein. Likewise, the IDCs and/or plug contacts may be unevenly spaced. The IDCs may, for example, lack the brace 36 in the slots that receive conductors. Also, the IDCs may lack the engagement recesses or may include some other structure (perhaps a tooth or nub) that engages a portion of the mounting substrate to anchor the IDCs. Also, IDCs as described above may be employed in connecting blocks of the "aligned" type or "staggered" type having no pair crossovers discussed above or in another arrangement. Furthermore, the upper sections 32 and the lower sections 30 of the IDCs may be physically separated from each other and mounted to a printed wiring board in arrays similar to FIGS. 6 and 7, with plated through-holes and traces on the board completing the connections between them. Likewise, the plug contacts could also be implemented using printed circuit boards to effect the crossover. Such printed circuit board implementations would still be considered to comprise "plug contacts" as that term is used herein.

In some embodiments of the present invention, the connecting block 22 may also include one or more parasitic conductive loops as disclosed and described in detail in co-pending U.S. patent application Ser. No. 11/369,457, filed on Mar. 7, 2006. the contents of which are incorporated by reference herein as if set forth in its entirety, The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A patch plug, comprising a plug housing;

a first tip plug contact and a first ring plug contact that form a first differential pair of tip and ring plug contacts, wherein the first tip and ring plug contacts are mounted within the plug housing so as to cross over each other;

a second tip plug contact and a second ring plug contact that form a second differential pair of tip and ring plug contacts, wherein the second tip and ring plug contacts are mounted within the plug housing so as to cross over each other and are mounted adjacent to the first differential pair of tip and ring contacts;

wherein each of the first and second tip and ring plug contacts includes an insulation displacement contact (IDC) portion and a blade portion; and wherein the IDC portions of the first and second tip plug contacts are aligned in a first row, and the IDC portions of the first and second ring plug contacts are aligned in a second row that is spaced apart from the first row.

2. The patch plug of claim 1, wherein a slot in the TDC portion of the first tip plug contact is generally aligned with a plane defined by the blade portion of the first ring plug contact, and wherein a slot in the DC portion of the first ring plug contact is generally aligned with a plane defined by the blade portion of the first tip plug contact.

3. The patch plug of claim 1, wherein the first differential pair of tip and ring plug contacts are balanced so as to impart substantially no differential-to-common mode crosstalk on the second differential pair of tip and ring plug contacts.

4. The patch plug of claim 1, wherein the IDC portions of the first and second tip plug contacts lie within a first plane and wherein the blade portion of the first tip plug contact lies within a second plane that is generally perpendicular to the first plane.

5. The patch plug of claim 1, wherein each of the first and second tip and ring plug contacts further comprises a cross-member that connects the IDC portion and the blade portion of each respective plug contact, and wherein the cross-member of the first ring plug contact overlies the cross-member of the first tip plug contact, and wherein the cross-member of the second ring plug contact overlies the cross-member of the second tip plug contact.

6. The patch plug of claim 5, wherein the cross-member of each of the first and second tip and ring plug contacts is configured such that the differential-to-differential crosstalk imparted by the first differential pair of tip and ring plug contacts onto the second differential pair of tip and ring plug contacts is substantially cancelled.

7. The patch plug of claim 1, in combination with a connector block, the connector block comprising:

a housing;

a first pair of tip and ring IDCs mounted in the housing;

a second pair of tip and ring IDCs mounted in the housing;

wherein each of the IDCs has a first end that has a first slot and a second end that has a second slot, the first end being offset from the second end; and wherein the tip IDCs are aligned in a first row within the housing and the ring IDCs are aligned in a second row within the housing, wherein the first tip plug contact is configured to mate with the first tip IDC, the first ring plug contact is configured to mate with the first ring IDC, the second tip plug contact is configured to mate with the second tip IDC and the second ring plug contact is configured to mate with the second ring IDC.

8. The patch plug in combination with a connector block of claim 7, wherein at least portions of the second end of each of the IDCs extend outside the housing through one or more openings in the housing.

9. The patch plug in combination with a connector block of claim 7, wherein the first slot and the second slot of each IDC are generally parallel and non-collinear.

10. A cross-connect wiring system, comprising:

a terminal block having a front side and a rear side;

a connecting block on the front side of the terminal block;

at least two pairs of tip and ring insulation displacement contacts (IDCs) that are at least partially mounted within the connecting block, wherein each of the IDCs has a first end that includes a first conductor receiving slot and a second end that includes a second conductor receiving slot, wherein the first and second ends of each IDC are non-collinear, and wherein both the first and second conductor receiving slots of each IDC are on the front side of the terminal block; and a patch plug that includes a housing and at least two pairs of tip and ring plug contacts, wherein the tip and ring plug contacts of at least one of the two pairs of tip and ring plug contacts cross over each other within the housing.

11. The cross-connect wiring system of claim 10, wherein the tip IDCs are aligned in a first row within the connecting block and the ring IDCs are aligned in a second row within the connecting block.

12. A cross-connect wiring system, comprising:

a connecting block that includes a plurality of pairs of tip and ring insulation displacement contacts (IDCs) mounted at least partially within the connecting block, wherein the tip IDCs are aligned in a first row and the ring IDCs are aligned in a second row, and wherein each of the IDCs has a first end for electrically connecting with a first mating conductor and a second end for mating with a second mating conductor, the first end being offset from the second end; and a patch plug that includes a housing and at least two pairs of tip and ring plug contacts, wherein each plug contact includes an IDC portion and a blade portion, wherein the IDC portions of the tip plug contacts are aligned in a first row and the IDC portions of the ring plug contacts are aligned in a second row, and wherein the tip and ring plug contacts of at least one of the pairs of plug contacts cross over each other within the housing.

13. The cross-connect wiring system of claim 12, wherein a slot in the IDC portion of the tip plug contact of the first pair of plug contacts is generally aligned with a plane defined by the blade portion of the ring plug contact of the first pair of plug contacts, and wherein a slot in the IDC portion of the ring plug contact of the first pair of plug contacts is generally aligned with a plane defined by the blade portion of the tip plug contact of the first pair of plug contacts.

14. The cross-connect wiring system of claim 12, wherein the first end of a first LDC of a first of the pairs of IDCs is substantially equidistant from the first ends of both IDCs of a second of the pairs of IDCs.

15. The cross-connect wiring system of claim 12, wherein the tip IDC and the ring IDC of each of the pairs of tip and ring IDCs cross over each other.

16. The cross-connect wiring system of claim 12, wherein each of the IDCs is substantially planar.

17. The cross-connect wiring system of claim 12, wherein the first pair of tip and ring plug contacts are balanced so as to impart substantially no differential-to-common mode crosstalk on the second pair of tip and ring plug contacts.

18. The cross-connect wiring system of claim 12, wherein the IDC portions of the tip plug contacts of each pair of tip and ring plug contacts lie within a first plane and wherein the blade portions of each tip plug contact of each pair of tip and ring plug contacts lie within respective planes that are generally perpendicular to the first plane.

19. The cross-connect wiring system of claim 12, wherein each of the tip and ring plug contacts further comprises a cross-member that connects the IDC portion and the blade portion of each respective plug contact, and wherein the cross-member of each ring plug contact of a pair overlies the cross-member of the respective tip plug contact of the pair.

20. The patch plug of claim 19, wherein the cross-member of each of the first and second tip and ring plug contacts is configured such that the differential-to-differential crosstalk imparted by the first pair of tip and ring plug contacts onto the second pair of tip and ring plug contacts is substantially cancelled.

21. A cross-connect wiling system, comprising:

a terminal block having a front side and a rear side;

a connecting block on the front side of the terminal block;

at least two pairs of connecting block tip and ring insulation displacement contacts (IDCs) that are at least partially mounted within the connecting block, wherein each of the connecting block IDCs has a first end that includes a first conductor receiving slot and a second end that includes a second conductor receiving slot, wherein the first and second ends of each connecting block IDC are non-collinear, and wherein both the first and second conductor receiving slots of each connecting block IDC are on the front side of the terminal block; and a patch plug that includes a housing and a first tip plug contact that has a first blade and a first IDC and a first ring plug contact that has a second blade and a second IDC, wherein the first tip plug contact and the first ring plug contact are configured to carry a first differential signal;

wherein the first blade is on a first side of the second blade, wherein the first IDC is on a second side of the second IDC, and wherein the second side is opposite the first side.

22. The cross-connect wiring system of claim 21, further comprising an index strip having a plurality of conductor receiving slots on the terminal block, wherein the connecting block is mounted on the index strip so that the first conductor receiving slot of each connecting block IDC is aligned with one of the plurality of conductor receiving slots of the index strip.

23. The cross-connect wiring system of claim 21, wherein the first conductor receiving slot comprises a slot of an insulation displacement contact and wherein the second conductor receiving slot comprises a slot that mates with the blade of a respective one of the plug contacts.

24. The cross-connect wiring system of claim 21, wherein the tip IDC and the ring IDC of each of the at least two pairs of connecting block IDCs cross over each other.

25. The cross-connect wiring system of claim 21, wherein the patch plug includes a plurality of additional tip plug contacts and a plurality of additional ring plug contacts, and wherein the IDCs of the tip plug contacts are aligned in a first row and the IDCs of the ring plug contacts are aligned in a second row.

26. The cross-connect wiring system of claim 25, wherein a slot of the IDC of the first tip plug contact of is substantially aligned with a plane defined by the blade of the first ring plug contact.

27. The cross-connect wiring system of claim 21, wherein the first tip and ring plug contacts are balanced so as to impart substantially no differential-to-common mode crosstalk on a second differential pair of tip and ring plug contacts.

* * * * *

UNITED STATES PATENT AND TRADEMARK OFFICE

CERTIFICATE OF CORRECTION

PATENT NO. : 7,503,798 B2
APPLICATION NO. : 11/734887
DATED : March 17, 2009
INVENTOR(S) : Hashim It is certified that error appears in the above-identified patent and that said Letters Patent is hereby corrected as shown below:

Column 3, Line 20: Please correct “from-n” to read -- from --

Column 7, Line 46: Please correct “IDs” to read -- IDCs --

Column 11, Line 43: Please correct “224*b*” to read -- 224*h* --

<u>In the Claims:</u>

Column 13, Claim 2, Line 12: Please correct “TDC” to read -- IDC --
Line 15: Please correct “DC” to read -- IDC --

Column 14, Claim 14, Line 46: Please correct “LDC” to read -- IDC --

Column 15, Claim 21, Line 9: Please correct “wiling” to read -- wiring --

Signed and Sealed this

Twelfth Day of May, 2009

JOHN DOLL
*Acting Director of the United States Patent and Trademark Office*